US007165734B2

(12) United States Patent
Bucher

(10) Patent No.: US 7,165,734 B2
(45) Date of Patent: Jan. 23, 2007

(54) DEVICE FOR MIXING AND HOMOGENIZING MATERIALS IN LABORATORY TEST CONTAINER WITH A STIRRING ELEMENT

(75) Inventor: Franz G. Bucher, Zug (CH)

(73) Assignee: Medic Tools AG, Matzingen (CH)

( * ) Notice: Subject to any disclaimer, the term of this patent is extended or adjusted under 35 U.S.C. 154(b) by 21 days.

(21) Appl. No.: 10/468,670

(22) PCT Filed: Oct. 4, 2001

(86) PCT No.: PCT/CH01/00597

§ 371 (c)(1),
(2), (4) Date: Aug. 19, 2003

(87) PCT Pub. No.: WO02/066147

PCT Pub. Date: Aug. 29, 2002

(65) Prior Publication Data

US 2004/0252582 A1 Dec. 16, 2004

(30) Foreign Application Priority Data

Feb. 22, 2001 (CH) ..... 324/01
Feb. 27, 2001 (CH) ..... 351/01
Jun. 23, 2001 (CH) ..... 1139/01

(51) Int. Cl.
*B02C 18/12* (2006.01)
*B02C 18/08* (2006.01)

(52) U.S. Cl. ..... 241/199.12; 241/46.11; 241/199.9

(58) Field of Classification Search ..... 241/46.11, 241/65, 67, 199.12, 199.9
See application file for complete search history.

(56) References Cited

U.S. PATENT DOCUMENTS 2,985,389 A 5/1961 Willems
3,220,450 A * 11/1965 Aronson, II et al. .... 241/199.12
3,380,499 A * 4/1968 Vocci et al. ..... 241/199.12
3,851,826 A 12/1974 Perlman
4,460,132 A * 7/1984 Thumm et al. ..... 241/46.11
4,948,056 A * 8/1990 D'Errico ..... 241/67
5,174,508 A * 12/1992 Martin ..... 241/21
5,533,683 A * 7/1996 Fay et al. ..... 241/169
5,829,696 A * 11/1998 DeStefano et al. ..... 241/169

FOREIGN PATENT DOCUMENTS

DE 36 38 656 A 5/1988
DE 195 32 015 A1 3/1997
GB 820574 A 9/1959

* cited by examiner

*Primary Examiner*—Lowell A. Larson
*Assistant Examiner*—Jason Y. Pahng
(74) *Attorney, Agent, or Firm*—The Webb Law Firm

(57) ABSTRACT

A device for mixing and homogenizing materials, especially infectious or chemically aggressive materials, which can be inserted into a laboratory test container. A disposable lid is provided to hermetically seal said laboratory test container. A stirring element is provided in the disposable lid for processing the material that is introduced into the laboratory test container. Said stirring element is fitted with a cutting element that rotates about the longitudinal axis of the laboratory test container, said cutting element processing the material together with additional cutting edges. Complete homogenization of tissue fragments can be securely achieved by hermetically closing the laboratory test container.

10 Claims, 8 Drawing Sheets

FIG. 6
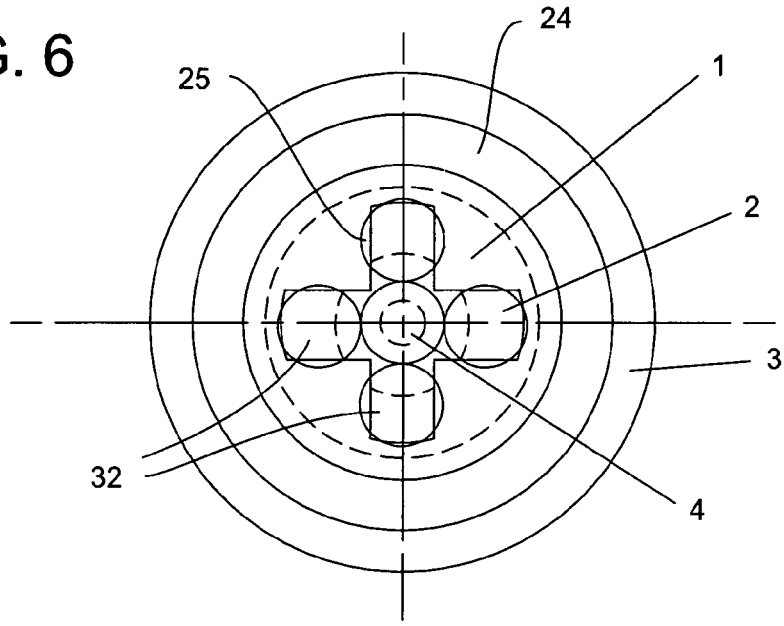
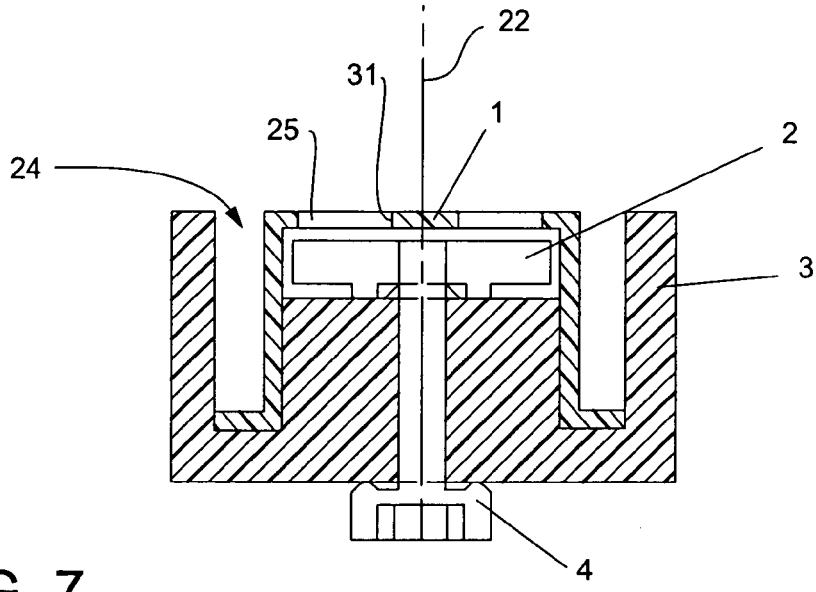
FIG. 7

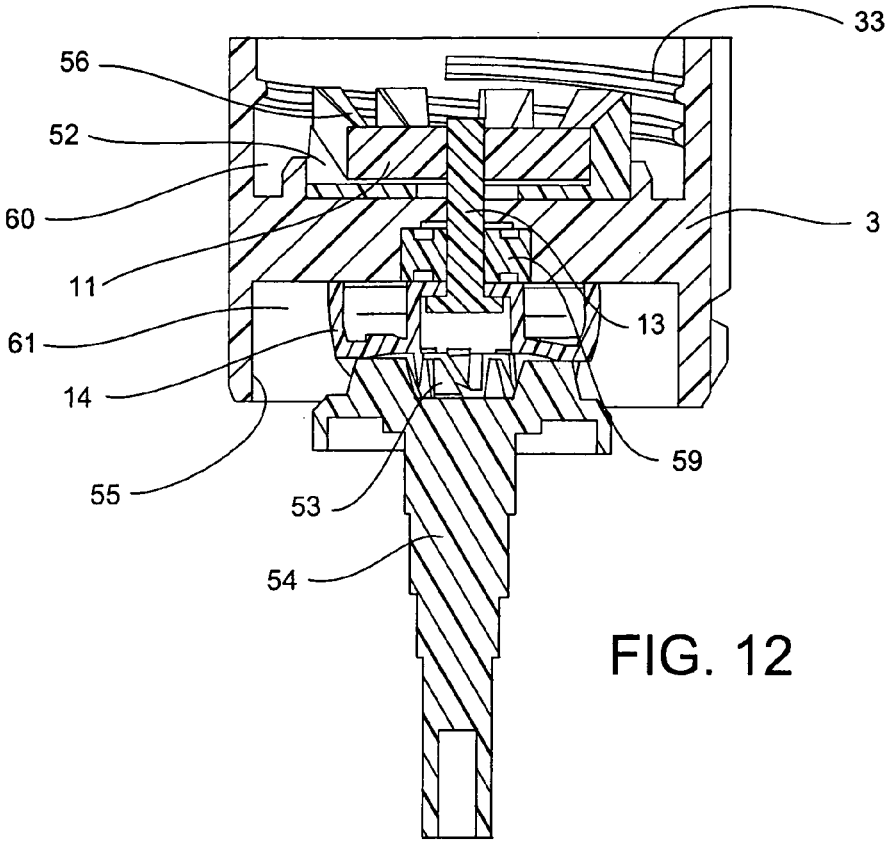
FIG. 12
FIG. 13
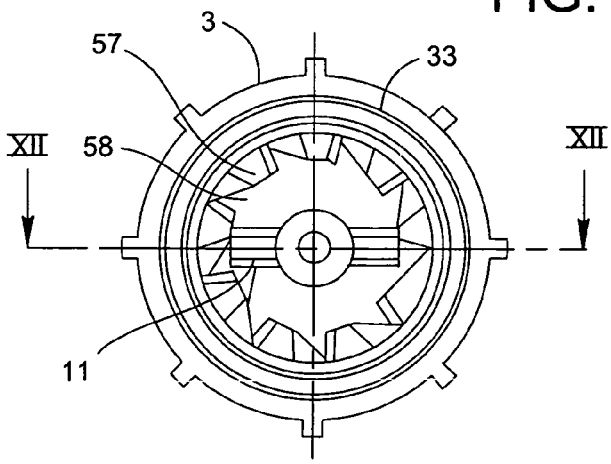

DEVICE FOR MIXING AND HOMOGENIZING MATERIALS IN LABORATORY TEST CONTAINER WITH A STIRRING ELEMENT

BACKGROUND OF THE INVENTION

1. Field of the Invention

The invention relates to a device for mixing and homogenizing materials, in particular infectious or chemically aggressive materials, in a laboratory test container.

2. Description of the Related Art

Magnetic stirrers and mechanical stirrers are generally known and customary in laboratory operation. During the comminution of infectious or chemically aggressive materials in containers which are not hermetically sealed, there is a high risk of infection and/or contamination as a result of uncontrolled splashes, which can penetrate to the outside through the opening of the laboratory test container, as a result of inadvertently tipping over the laboratory test container and as a result of the use of repeated-use mixers. This is the case in particular in the case of test tubes and mixers known for this purpose.

On the basis of this prior art, it is an object of the present invention to provide a device of the type mentioned at the beginning which permits hermetic sealing of the laboratory test container and complete, thorough mixing of miscible substances and liquids.

SUMMARY OF THE INVENTION

The invention, provides for a device for mixing and homogenizing materials, in particular infectious or chemically aggressive materials, in a laboratory test container with a stirring element. The device comprises a lid to seal the laboratory test container hermetically. The stirring element is provided in the lid to process the material that can be introduced into the laboratory test container. A cutting element is also provided in the lid, wherein the cutting element rotates about a longitudinal axis of the laboratory test container and which is arranged in the immediate vicinity of farther cutting edges.

The fact that a lid is provided, with which, at the same time, the laboratory test container is sealed hermetically and materials in the laboratory test container are processed, in particular mixed and homogenized, means that the working safety of the user performing the processing is increased significantly. This means that infectious tissue fragments can also be handled safely. As a result of the hermetic sealing of the laboratory test container, complete homogenization of the tissue fragments can thus be achieved in a safe way.

The lid is advantageously configured as a disposable lid, so that it is disposed of immediately after use and thus contamination during further work in the laboratory is reliably avoided.

BRIEF DESCRIPTION OF THE DRAWINGS

The invention will be explained in more detail below using various exemplary embodiments and with reference to the appended drawings, in which:

FIG. 6 shows a schematic plan view of the disposable lid of the second exemplary embodiment according to FIG. 5, FIG. 7 shows an illustration of the disposable lid from FIG. 5, FIG. 12 shows a schematic, sectioned view of a disposable lid according to a fourth exemplary embodiment of the invention, and FIG. 13 shows a plan view of the disposable lid from figure 12.

DETAILED DESCRIPTION OF THE INVENTION

Figure 1:
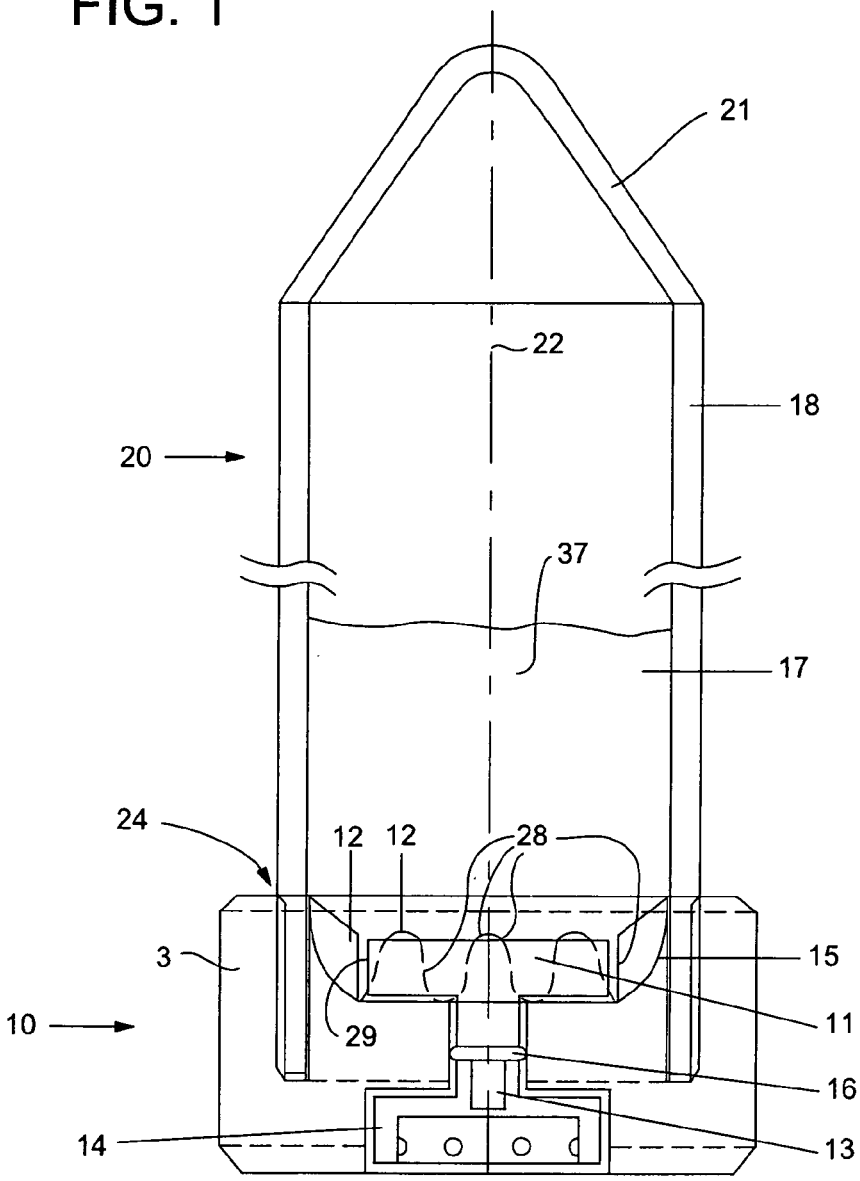
FIG. 1 shows a schematic, partly sectioned lateral view of a first exemplary embodiment of the invention.

FIG. 1 shows a schematic, partly sectioned lateral view of a first exemplary embodiment of the invention. A laboratory test container is provided with the reference symbol 20. In this case, this is a small cylindrical tube 18 with a conically tapering point 21. The interior 17 of the laboratory test container 20 is filled with the materials 37 to be mixed. The laboratory test container 20 is then sealed with the disposable screw-closure lid 10 in the use of the latter and then inverted.

Provided in the disposable screw-closure lid having a tube portion and a cap portion or disposable snap-action cap (snap cap) 10 of the hermetically sealable laboratory test container 20 is an inserted, four-edged plastic or metal bar 11 provided with radial and axial cutting edges 29, which is led past the cutting edges 28 of the cutting ribs 12 provided on an inner surface of the tube portion. This bar 11 is driven from outside the laboratory test container 20 with the aid of the shaft 13 by an internal-hexagon quick coupling ring 14.

The laboratory test container 20 with the materials to be mixed and homogenized is placed on an external drive with a force fit via the coupling ring 14 with the inverted container position corresponding to FIG. 1. By means of the transmitted rotational movement, the substances and liquids in the interior 17 of the container 20 are sucked in axially by the bar 11, that is to say along the longitudinal axis 22 of the laboratory test container 20, and thrown out radially. In the process, under the cutting action at the peripheral cutting ribs 12, they are expelled through the slots. As a result, the material to be mixed is squeezed, mixed, homogenized and subsequently deflected upward at the mixer wall 15, which in each case extends between the cutting ribs 12. The sealing ring 16 placed around the shaft 13 prevents the liquid running out. The rotational energy is transmitted mechanically to the bar 11 from outside to the coupling ring 14 and the shaft 13. The rotational speed is defined specifically to the material for optimum homogenization. The sealing ring 16 can be implemented by means of a sealing lip.

Figure 2:
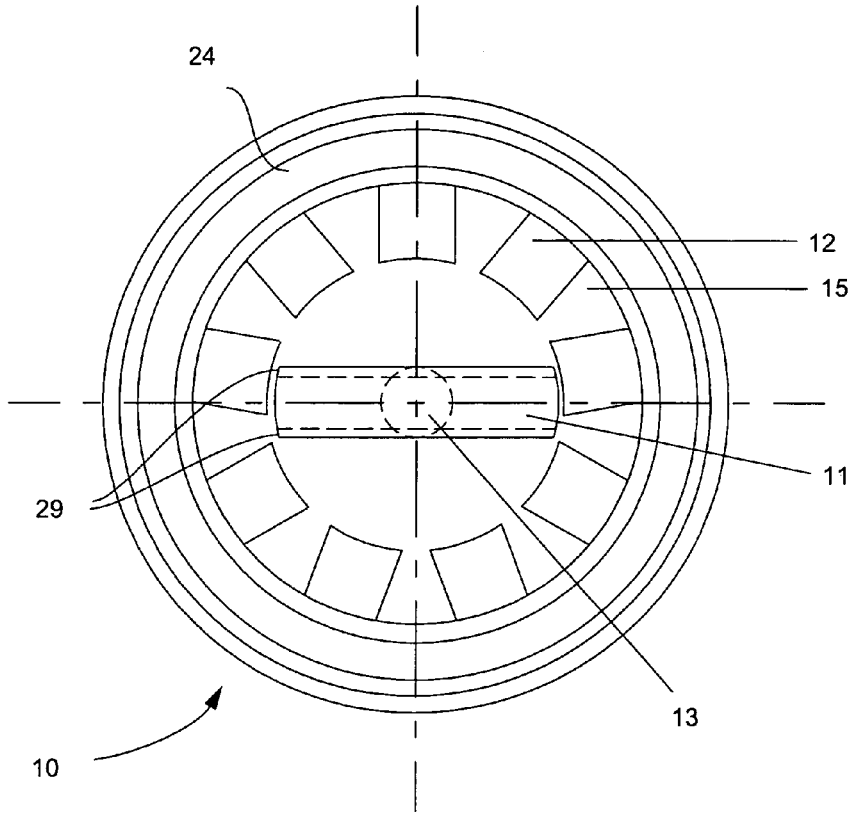
FIG. 2 shows a schematic plan view of the disposable lid of the first exemplary embodiment according to FIG. 1.

FIG. 2 shows a schematic plan view of the disposable lid 10 of the first exemplary embodiment according to FIG. 1. Identical features are provided with the same reference symbols in all the figures. The cutting lips 12 are formed by an element arranged in a wave shape on the circumference, which here comprises nine lips. The bar 11 can, for example, be formed in a U shape, open at the bottom, so that there are two vertical cutting edges 29 on both sides of the bar 11. These respectively two cutting edges 29 are at a short distance opposite the cutting edges 28, eighteen here (two times nine), of the cutting lips 12.

Figure 3:
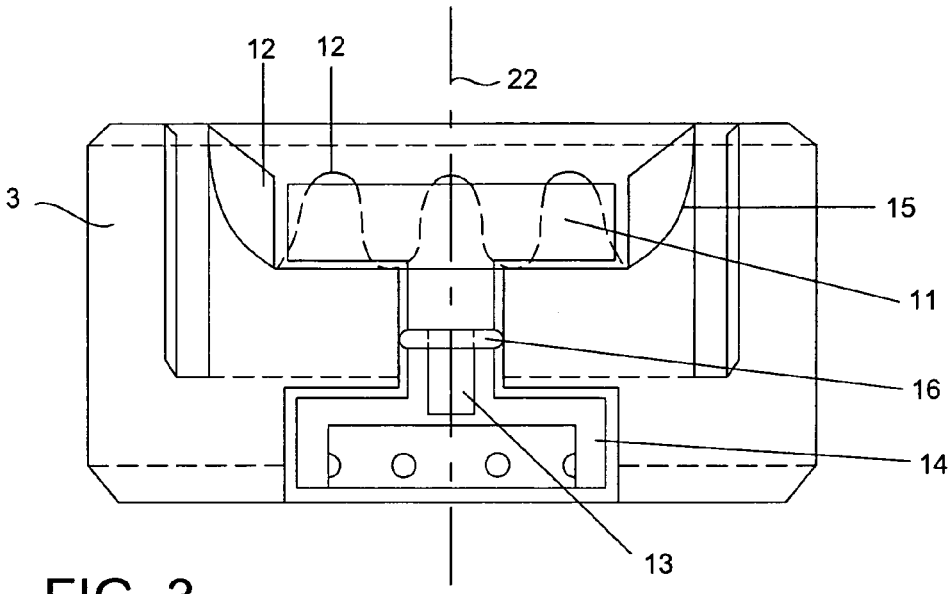
FIG. 3 shows an illustration of the disposable lid from FIG. 1.
Figure 4:
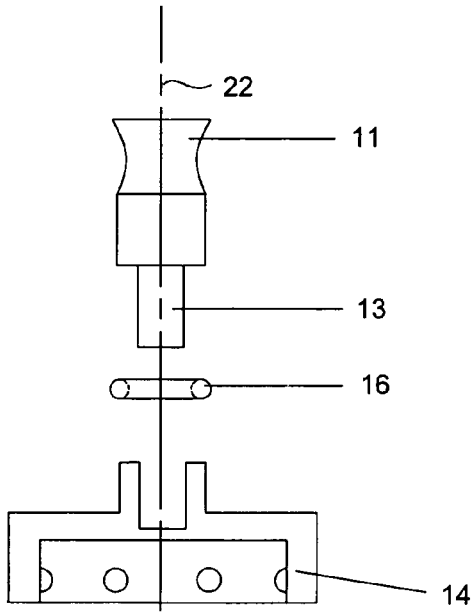
FIG. 4 shows an exploded illustration of the drive from FIG. 1 used in the disposable lid.

FIG. 3 shows an isolated representation of the disposable lid 10 from FIG. 1, in which all the elements essential for the transmission of the rotational movement have been inserted into the body 3. FIG. 4 shows an exploded illustration of the drive from FIG. 1 used in the disposable lid 10, comprising the bar 11 with shaft 13 connected in one piece, the sealing ring 16 and the coupling ring 14, which are all arranged around the longitudinal axis 22 of the device.

Figure 5:
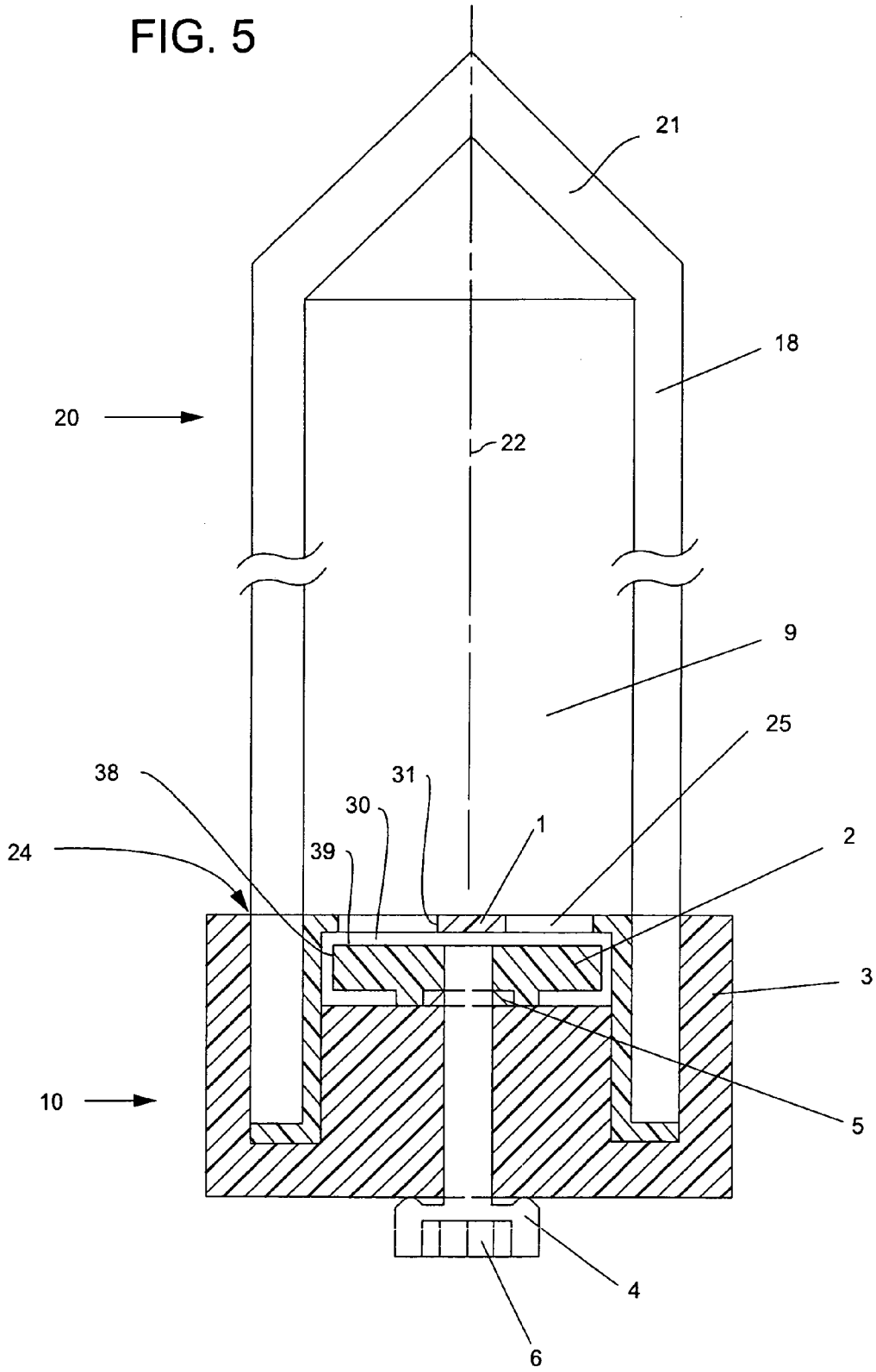
FIG. 5 shows a schematic, partly sectioned lateral view of a second exemplary embodiment of the invention.

FIG. 5 shows a schematic, partly sectioned lateral view of a second exemplary embodiment of the invention. The disposable lid 10 has a body 3 defining a cylindrical tube portion having a first end and a second end and a cap portion which has a circumferential groove 24, between the tube portion and the cap portion into which the laboratory test container 20 can be plugged or screwed. The first end of the tube portion is attached to the cap portion and extends from the first end to the second end away from the cap portion, wherein the container 20 is received within the groove 24 whereby the tube portion extends a distance within the container 20 and abuts against an interior 9 of the laboratory test container. On the inner side of the circumferential groove 24, a sealing element 1 is inserted, which simultaneously seals off the interior 9 of the laboratory test container 20 hermetically with respect to the outside. The sealing element 1 simultaneously has a perforated disk which is arranged transversely with respect to the longitudinal axis 22 and which forms a cavity 30, which forms a cylindrical cage or tube portion, with respect to the body 3. Arranged in this cavity 30 is a spider 2. The spider 2 has radial 39 and peripheral 38 cutting edges provided between the first end and the second end of the tube portion, which are led past the corresponding cutting edges 31 of the inlet holes 25. The laboratory test container 20 with the materials to be mixed is then sealed by the disposable lid 10, inverted and placed on the external drive with a force fit via the drive shaft 4 and the connection 6. A sealing lip 5 prevents the liquid running out. The rotational energy is transmitted mechanically to the bar 11 from outside to the coupling ring 14 and the shaft 13. The rotational speed is defined specifically to the material for optimum homogenization. The sealing ring 16 can be implemented by means of a sealing lip.

FIG. 6 shows a schematic plan view of the disposable lid of the second exemplary embodiment according to FIG. 5. In the disk region, the sealing element 1 here has four apertures 25, which have a radial spacing from the shaft 22 and are arranged with an angular spacing of 90 degrees in relation to one another. Here, the cutting element is a spider 2 having four arms 32. Instead of four apertures 25 and one spider 2 with four arms 32, corresponding elements with three or, for example, five apertures/arms are also possible. The spider 2 can be a four-edged plastic cross.

FIG. 7 shows an illustration of the disposable lid from FIG. 5.

Figure 8:
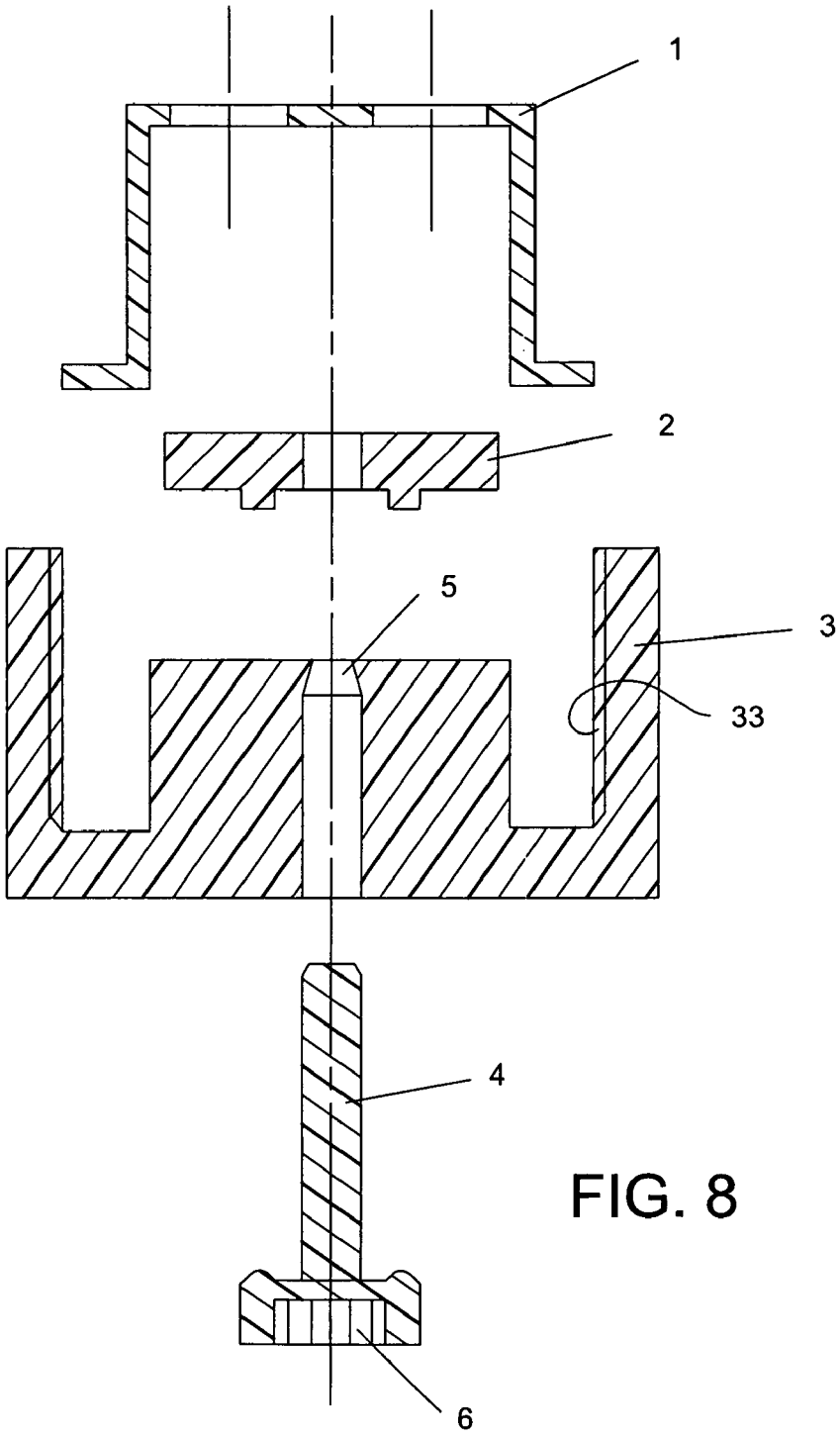
FIG. 8 shows an exploded illustration of the drive from FIG. 5 used in the disposable lid.

FIG. 8 shows an exploded illustration of the drive from FIG. 5 used in the disposable lid 10, which drive comprises the four elements. In this case, the reference symbol indicates that the laboratory test container 20 is screwed into the circumferential groove, which has an appropriate thread 33 on its outer side.

In particular, the drive shaft 4 can be thermally conductive, so that thermal energy can be introduced into the laboratory test container 20 or dissipated to the outside from the latter via this drive shaft 4. Provision can also be made for electrical energy to be introduced into the laboratory test container 20 via the drive shaft 4 and/or for electrochemical sensors to be used.

Figure 9:
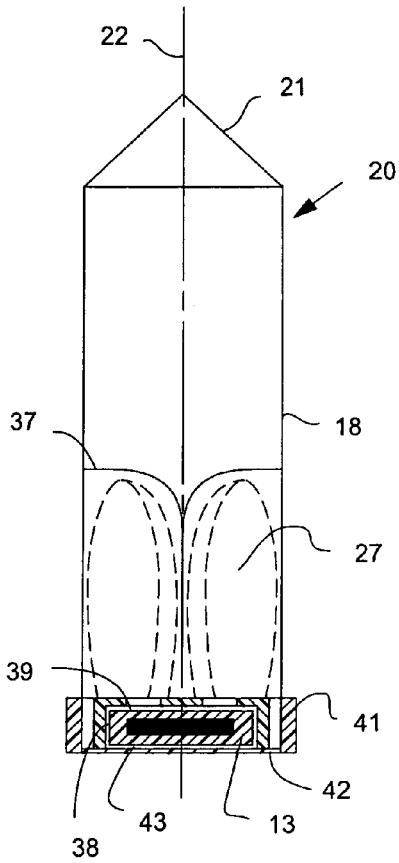
FIG. 9 shows a schematic, partly sectioned lateral view of a third exemplary embodiment of the invention.

FIG. 9 shows a schematic, partly sectioned lateral view of a third exemplary embodiment of the invention. A rotary vane or rotor 13 in a cylindrical cage 42 is integrated into the lid 10. The cylindrical cage 12 is inserted into a body 41 of the lid 10 and has four radially oriented, oval apertures 26, through which the material to be homogenized is guided into the cavity 30 in the cage 42 and is cut there by the rotor 13.

The inert rotor 13, which can be formed by a bar magnet 43 or comprises the latter as a core, has radial 39 and peripheral 38 cutting edges, which are led past the corresponding cutting edges 31, that is to say the edges of the openings 26, of the cylindrical cage 42. The laboratory test container 20 with the tissue material 27 is put into the drive standing on the lid, so that the result is a filling level 37 and the material is in contact with the cage 42 and the rotor 13. The known drive, not illustrated in the drawings, comprises a further magnetic rotor, with which the rotational energy is transmitted magnetically or electromagnetically. The magnetic field strength is dimensioned such that a torque which is optimal for the homogenization is transmitted.

Figure 10:
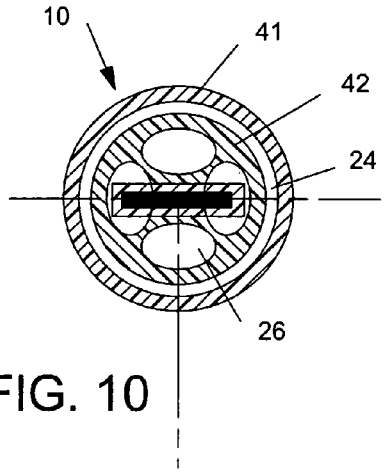
FIG. 10 shows a schematic plan view of the disposable lid of the third exemplary embodiment according to FIG. 9.
Figure 11:
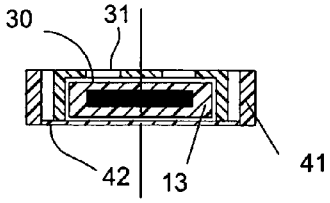
FIG. 11 shows an illustration of the disposable lid from FIG. 9.

FIG. 10 shows a schematic plan view of the disposable lid 10 of the third exemplary embodiment according to FIG. 9, and FIG. 11 shows an illustration of the disposable lid from FIG. 9. The circular groove 24 permits the laboratory test container 20 to fit in the lid 11 with a fit which goes beyond a form fit. The magnetic bar 13 is constructed asymmetrically, so that by means of the fluidically optimized construction, in one direction of rotation, a central liquid stream from top to bottom [lacuna] produced and, in the other direction of rotation, a lateral liquid stream along the wall of the laboratory test container 20 from top to bottom [lacuna] produced. The suction and expulsion action is thus changed by means of a reversal of the direction of rotation.

FIG. 12 shows a schematic, sectioned lateral view of a disposable lid according to a fourth exemplary embodiment of the invention, and FIG. 13 shows a plan view of the disposable lid from FIG. 12. In addition, the connection is also illustrated here. The differences from the exemplary embodiment from FIG. 1 are, in particular, as follows. The quick coupling ring 14 has teeth on its underside, which engage in teeth 53 belonging to a drive shaft 54. The bottom edge 55 of the body 3 is in particular drawn downward to such an extent that the lid 10 can be put in place flat without the teeth of the quick coupling ring 14 protruding.

A ball bearing for the shaft 13 is designated by the reference symbol 59. However, such a ball bearing is not necessary for cost-effective fabrication of the device as a disposable lid 10. It can in particular be replaced by a sliding mounting of the drive shaft 13, not illustrated in the drawings, the sealing being provided by an inserted O-ring. This is advantageous in particular since, in the case of a disposable lid 10, the bearing is loaded and must withstand this load only once and then for only a short time.

Here, the cage 52 simultaneously forms cutting edges, which do not consist of apertures as in the second exemplary embodiment, nor of a purely lateral element as in the first exemplary embodiment. The cage 52 has lugs 56 which are drawn downward and embrace the bar 11. The latter is equipped with two arms, but a spider 2 with more arms can also be provided. The cutting edges 57 can be seen in particular in the plan view of FIG. 13, cavities 58 are [sic] adjacent lugs 56 picking up material in order then to cut it off with the bar 11.

Not illustrated in the drawings are the following features, which can be accommodated in all the embodiments illustrated in the figures. Beside the bar, for example in the region 60 and 61 in FIG. 12, sensor lines can be led through the body 3 and have electrical connections on the side pointing outward. Thus, during mixing, a sensor can be arranged in a straightforward manner in the vicinity of the bottom of the material to be processed. Instead of sensor lines, an optical conductor can also be led through, or a feed line which forms a heating body or a Peltier element in the interior 60.

The invention claimed is:

1. A device for mixing and homogenizing materials, in particular infectious or chemically aggressive materials, in a laboratory test container with a stirring element, the device comprising a lid and the laboratory test container, the lid defining a cylindrical tube portion having a first end and a second end and a cap portion, wherein the first end of the tube portion is attached to the cap portion and extends from the first end to the second end away from the cap portion thereby defining a groove between the tube portion and the cap portion and, wherein the laboratory test container is received within the groove whereby the tube portion extends a distance within the laboratory test container and abuts against an inner surface to seal the laboratory test container hermetically, the stirring element is provided in the lid to process the material that can be introduced into the laboratory test container, and a cutting element having cutting edges is provided between the first end and the second end of the tube portion of the lid, wherein the cutting element rotates about a longitudinal axis of the laboratory test container and which is arranged in the immediate vicinity of second cutting edges provided on an inner surface of the tube portion of the lid.

2. The device as claimed in claim 1, wherein the second cutting edges on the lid are provided in one piece or as an additional element.

3. The device as claimed in claim 1, wherein the lid is a disposable lid and/or in that the cap portion of the lid has a screw closure or a snap closure, which is complementary to a corresponding element on the laboratory test container.

4. The device as claimed in claim 1, wherein the laboratory test containers are cylindrical or cuboid and/or in that the laboratory test containers consist of plastic or glass.

5. The device as claimed in claim 1, wherein the processing of the material comprises squeezing, mixing and homogenizing it.

6. The device as claimed in claim 1, wherein the cutting edges are radial and/or peripheral to the cutting element which consist of plastic or metal.

7. The device as claimed in claim 1, wherein the cap portion of the lid has a sealing ring for the hermetic closure between the interior of the laboratory test container and the external environment.

8. The device as claimed in claim 1, wherein the rotational energy supplied is supplied from the outside via a mechanical internal-hexagon quick coupling ring or a mechanical plug-in connection or a non-contact magnetic coupling, the cutting element comprising a magnetic bar which can be rotated from outside about the longitudinal axis by a rotating electromagnetic field.

9. The device as claimed in claim 1, wherein thermal energy can be introduced into the laboratory test container or dissipated to the outside from the latter via a thermally conductive drive shaft.

10. The device as claimed in claim 2, wherein the lid is a disposable lid and/or in that the cap portion of the lid has a screw closure or a snap closure, which is complementary to a corresponding element on the laboratory test container.

* * * * *